United States Patent [19]

Repetto

[11] 4,100,773

[45] Jul. 18, 1978

[54] DRYING PRESS FOR HIDES

[75] Inventor: Silvio Repetto, Modena, Italy

[73] Assignee: S.p.A. Luigi Rizzi & C., Modena, Italy

[21] Appl. No.: 714,755

[22] Filed: Aug. 16, 1976

[30] Foreign Application Priority Data

Sep. 3, 1975 [IT] Italy ..... 26874 A/75

[51] Int. Cl.[2] ..... C14B 1/30; B30B 9/24

[52] U.S. Cl. ..... 69/48; 69/41; 100/118; 100/151

[58] Field of Search ..... 100/118, 151; 69/29, 69/32, 47, 48, 41, 42; 226/171, 172; 8/94.1 R; 144/281 B; 34/148, 151, 162, 236, DIG. 16

[56] References Cited

U.S. PATENT DOCUMENTS

| | | | |
|---|---|---|---|
| 1,140,676 | 5/1915 | Gray | 100/151 |
| 1,908,807 | 5/1933 | Ashley | 100/118 |
| 2,233,495 | 3/1941 | Stehling | 69/47 |
| 3,727,437 | 4/1973 | DoKoupil | 69/48 |

FOREIGN PATENT DOCUMENTS

| | | | |
|---|---|---|---|
| 2,065,769 | 8/1971 | France | 69/49 |

*Primary Examiner*—Stanley N. Gilreath
*Attorney, Agent, or Firm*—Kurt Kelman

[57] ABSTRACT

A press comprises two cooperating endless belts each trained over a support and tensioning roller. The end supports of the support roller for the lower belt rest on a hydraulically actuated piston which enables this support roller to be displaced towards the other support roller. Two pairs of like bracing members hold the end supports of the support rollers, the bracing members of each pair having one end pivoted to a respective hydraulic cylinder for the pistons and the end supports of the other support roller being detachably fixed to the other bracing member ends. Each pair of bracing members defines a guide for the displacement of the end supports of the support roller for the lower belt. One of the end supports of each support roller is pivotally mounted for pivoting the support rollers in a plane defined by the axes of the support rollers.

5 Claims, 5 Drawing Figures

DRYING PRESS FOR HIDES

The present invention concerns a press for the drying of wet hides during or after tanning or the like, in which the drying of the hide is effected by squeezing it between two felt or the like endless belts supported on opposing rollers and pressed against each other. Machines for drying the wet hide by squeezing it between two endless felt belts are already known, and it is alo known that felt belts may be used over long periods of time without the necessity of maintenance. However, the felt belts in the long run are subjected both to wear and tear and deformations, as also breakages or the like, and therefore the belts have to be periodically replaced. Endles belts can be removed from and placed on associated support and tension rollers only from one side of the apparatus. The technical problem involved in this concerns, therefore, the construction and general design of the apparatus itself and/or particular device which allow the belts to be laterally disconnected at the most convenient, rapid and rational movement.

In the case of known machines in which this problem has not been taken into consideration or only partially so, it is necessary for the removal of the belts, to dismantle the machine so as to remove one side, releasing all the associated connections and eliminating the pressure and transmission rollers. In view of the dimensions and weight of individual parts of machines of this type, these operations involve a considerable loss of time with consequent prolonged stopping of the machine itself. In order to solve the problem of the removal of the belts from the side, it has also been proposed to provide the machine with a large E-shaped frame, the lower horizontal shank of which constitutes the support base of the assembly and of the upright side, the intermediate horizontal shank supports the lower roller, the pressure and transmission means associated with the lower belt, and the upper shank supports the upper roller and the transmission rollers associated with the upper belt.

For normal use of the machine the E-shaped frame is closed on the open side by means of a large plate which is connected to the ends of the three horizontal shanks by screws or the like.

Although this solution permits lateral removal of the felt belts by taking away the side plate, it nevertheless results in serious disadvantages to the general construction of the machine because, in view of the appreciable weight of the pressure and transmission rollers, as well as the pressure and support means of the rollers, the horizontal shanks of the frame and the upright have to resiliently support the entire assembly and therefore have to be made with dimensions and weights enormously greater than those necessary for the normal operation of the machine. In addition, the general structure is not counterpoised from the point of view of the tensions, deformations and dilations on account of the abnormal deformities of the structures of the two effective sides.

The continuous belt press according to the present invention at least substantially minimizes this technical problem without having the above-mentioned disadvantages and also has considerable advantages in its speed of execution, reduced weight and costs, as also complete equality of tensions, deformations and dilations of both the sides under stress.

In accordance with the present invention, there is provided an endless belt press for drying of wet hides or the like, which comprises an upper endless belt and a lower endless belt cooperating with the upper belt, a belt support roller and a belt tensioning roller for each belt, the endless belts being trained over the support and tensioning rollers therefor, the support rollers, with the belts trained thereover, defining a press nip therebetween, and a pair of end supports for each of the support rollers. A respective one of the end supports of the support roller for the lower belt rests on a respective thrust means arranged to exert a thrust against the support roller for the lower belt for displacing the same towards the support roller for the upper belt. The press further comprises two pairs of like bracing members, the bracing members of each pair having one end pivoted to a respective one of the thrust means for pivoting in a plane substantially perpendicular to the axes of the support rollers, each pair of bracing members defining a guide for the displacement of the end supports of the support roller for the lower belt and the end supports of the support roller for the upper belt being detachably fixed to the other ends of each pair of bracing members. A pivot mounting for one of the end supports of each support roller is arranged to permit pivoting of the support rollers in a plane defined by the axes of the support rollers, and traction means is connected to the one end support of each support roller for pivoting the support rollers on the pivot mounting whereby the other end supports thereof are raised and the raised end support of the support roller for the lower belt no longer rests on the thrust means.

In this manner, the raised end supports of the support rollers remain free of any connection. In a preferred embodiment, the apparatus is constructed for permitting one of the ends of the tensioning rollers also to be free.

Preferably, the bracing members are identical tie rods adapted to absorb the stresses at both ends supports of the support rollers equally and to guide the end supports of the lower support roller when it is displaced towards the upper roller.

One of the bracing members of each pair may be detachably connected to side plates of the press to keep the pairs of bracing members upright when they are not in tension and for absorbing the tension of the endless belts in a horizontal direction.

The present invention will be further illustrated, by way of example, with reference to the accompanying drawing, in which.

Figure 1:
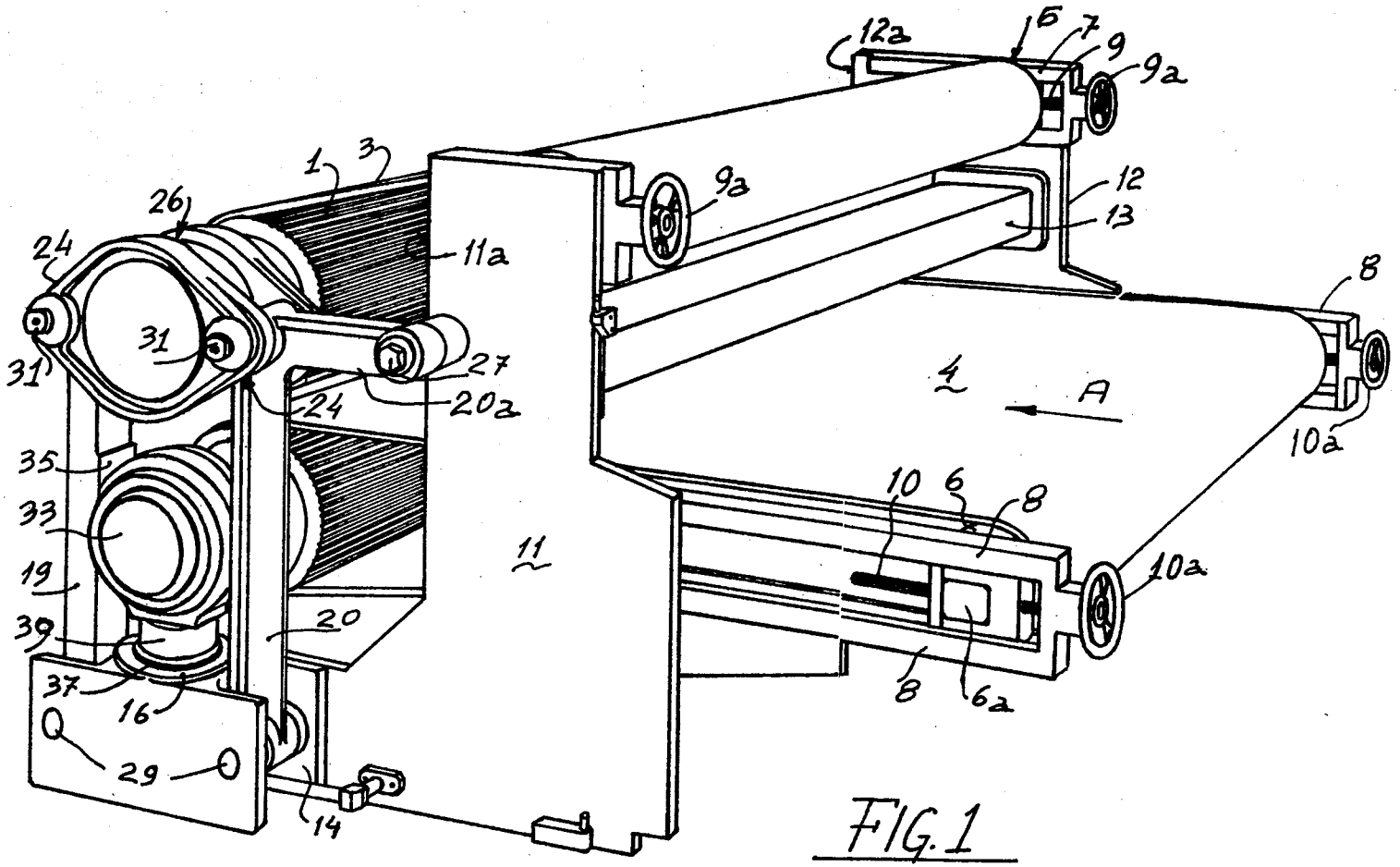
FIG. 1 is a perspective view of an apparatus in accordance with the invention.
Figure 2:
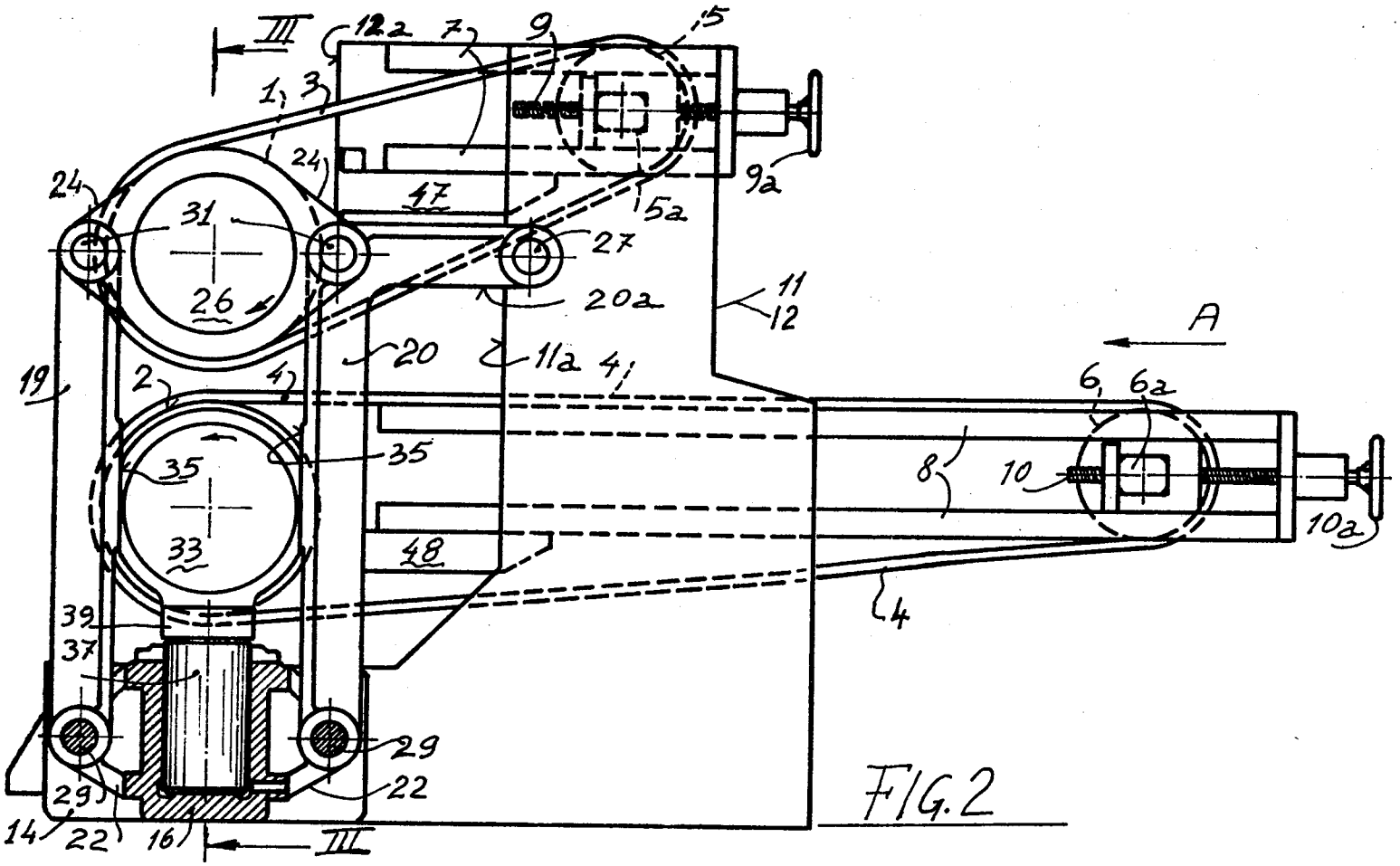
FIG. 2 is a side view of the apparatus with an axial section through a pressure cylinders.
Figure 3:
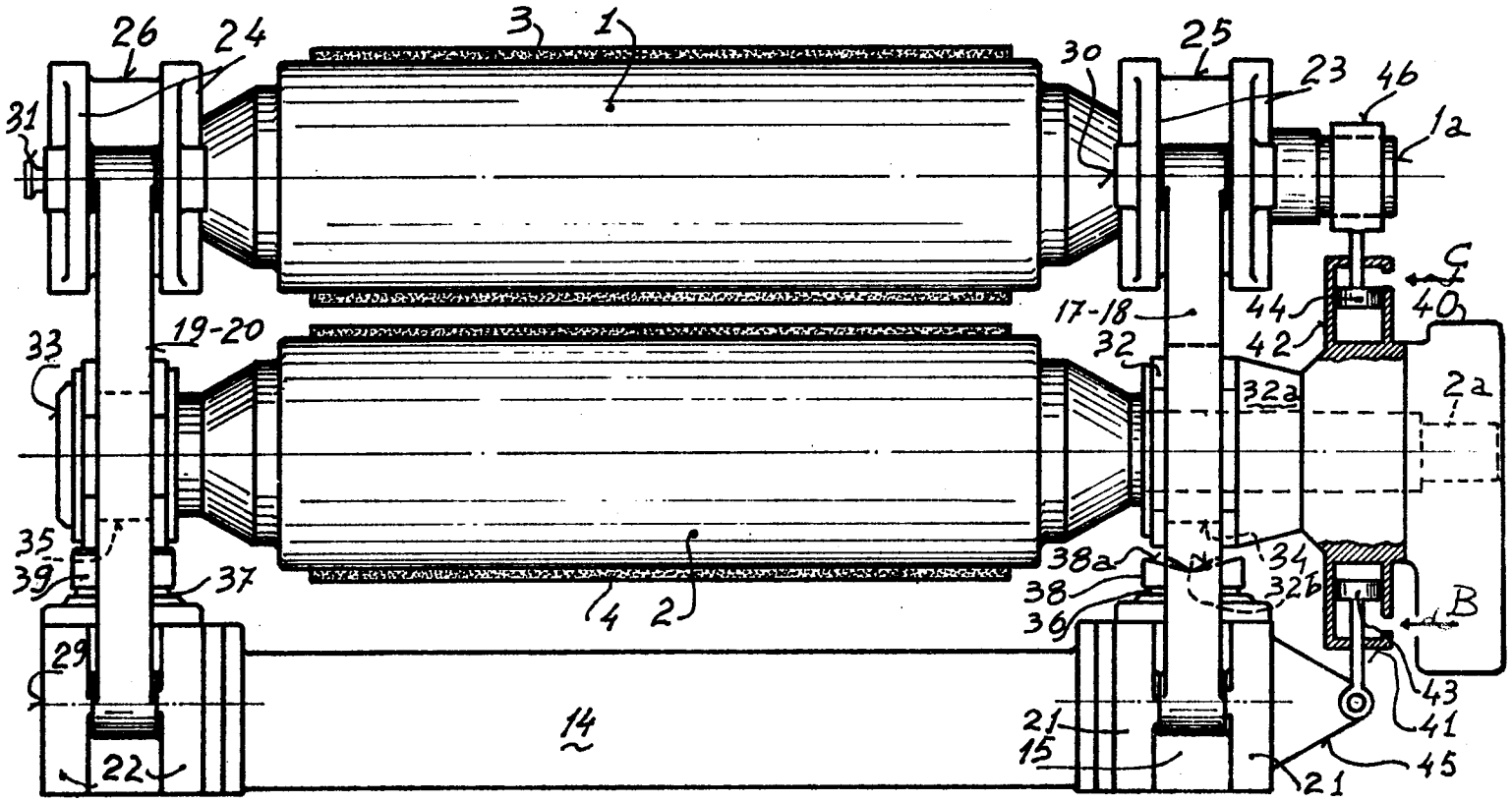
FIG. 3 is a front view, partially in section, taken on the line III — III of FIG. 2.

With reference to FIG. 1, 2 and 3, the continuous press is formed by a pair of upper and lower pressure rollers 1 and 2 respectively, an endless belt of felt 3 trained around roller 1, and a similar belt 4 trained around roller 2. Both belts 3 and 4 are subjected to tension by respective tension rollers 5 and 6 whose end supports 5*a*, 6*a* are slidable along respective horizontal guides 7 and 8 when removed from respective spindles 9 and 10 by control handwheels 9*a*, 10*a*.

The horizontal guides 7 and 8 are connected to two side plates 11, 12 held rigidly in position by a cross bar 13 or the like. At the front of the machine, corresponding to the pressure rollers 1, 2 a base cross bar 14 is provided for spacing apart and connecting the side support groups of the end supports on rollers 1, 2 and for the support of the pressure cylinders 15, 16. Each of the side support groups comprises a pair of bracing members 17, 18 and 19, 20 respectively, pivoted at the bottom on the lugs 21 connected to the pressure cylinder 15 on one side and on the lugs 22 connected to the pressure cylinder 16 on the other side, whilst these bracing members are pivoted at the top on the lugs 23 and 24 of the end supports 25 and 26 of the upper pressure roller 1.

One of the two bracing members of each pair, i.e. members 18, 20 facing the side plates of the machine, is provided with horizontal extensions 18*a*–20*a* respectively connected by screws or pins 27 to the side plates themselves.

The bracing members 17, 18 and 19, 20 are connected to the respective lower lugs 21, 22 by fixed studs 28 and 29 whilst they are connected to the upper lugs 23 by fixed studs 30 and by pins 31 removable in the direction of the lugs 24. The end supports 32, 33 of the lower pressure roller 2 are displaceable between the pairs of bracing members, said supports being guided vertically by plane surfaces 34, 35 of the bracing members themselves and rest by their lower end on pistons 36, 37 displaceable within the cylinders 15, 16.

For convenience of construction and for limiting the movement of the pistons 36, 37, members 38, 39, which are easily removable, as will be explained hereinafter, are preferably interposed between the ends of the pistons themselves and the lower part of the supports.

FIG. 3 shows, according to the invention, that the lower roller 2 is extended at one end by a shaft 2*a* which, being supported by normal bearings (not shown), extends to motor 40. The motor may be of the hydraulic, electric or the like type, the housing of which is connected to an extension 32*a* of the support 32. On the same side of the apparatus, the end of the pivot of the upper roller 1 is extended beyond the support 25 by a shaft 1*a*; extensions 1*a*, 2*a* of the rollers 1 and 2 are, in association with an oscillating bearing of known type (not shown), mounted on the upper support 25 and with an edgewise support 32*b* oscillating on the V-shaped seat 38*a* of the spacing member 38. Vertical forces adapted to raise, by making a fulcrum on said supports, the opposite end of said rollers eliminate the pressure due to the actual weight thereof on the pins 31 for connection to the bracing members 19, 20 and on spacing members of the support 33 on the piston 37.

For this purpose, and by way of example, FIG. 3 shows the means adapted to this purpose, of hydraulic type, consisting of a pair of opposing cylinders 41, 42 connected to the housing 32*a* of the support 32 of the lower roller, in which cylinders are located the respective pistons 43 and 44, the first being connected to a fixed bracket 45 connected to the cylinder 15 and the second to a collar 46 sliding on the end 1*a* of the roller 1.

Figure 4:
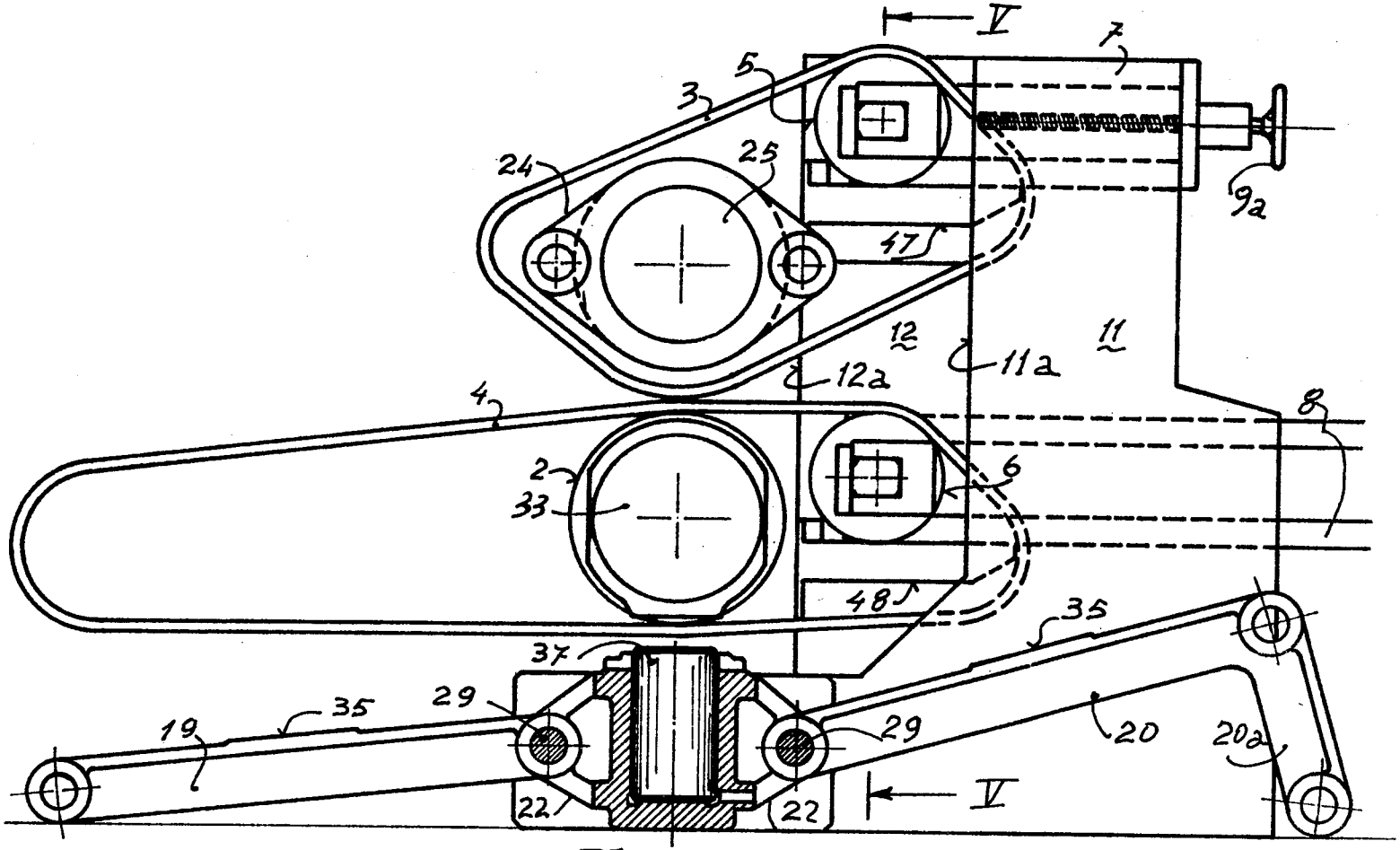
FIG. 4 is an end view of the apparatus of FIG. 2, in position for the removal of the belts.
Figure 5:
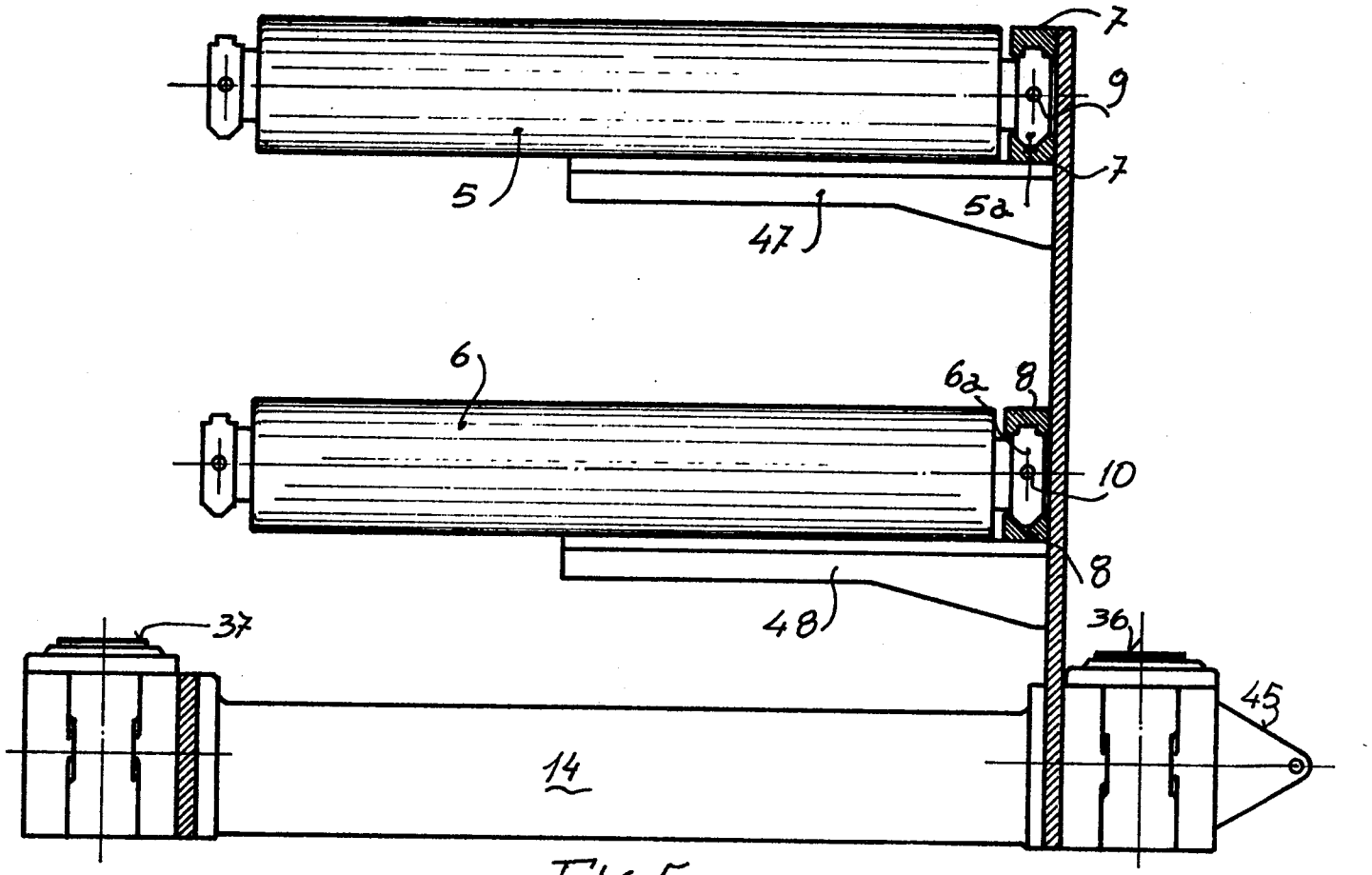
FIG. 5 is a partial view in section, taken on the line V — V of FIG. 4, of the tension rollers in position for the removal of the belts.

With reference to FIGS. 2, 4 and 5, it is seen that one of the two side plates, the one opposite the side of the motor 40, indicated by 11, is cut away to have an edge 11*a* spaced from edge 12*a* of the opposite side plate 12 and that two brackets 48 and 47 are resiliently connected to the side plate 12 and disposed transversely below the guides 7 and 8 on which slide the end supports 5*a*, 6*a* of the tension rollers 5, 6. The brackets 47, 48 are disposed in the space between edges 11*a* and 12*a* so that the rollers themselves may rest thereon when they are placed in this position, being connected to the plate 12 by the ends 5*a*, 6*a* on the guides 7 and 8, whilst they are free at the other end, as shown schematically in FIG. 5.

Operation is as follows: Assuming the press is in operation, the hide to be dried is supported on the lower belt 4 and therefore advanced in the direction of the arrow A so as to be pressed between the belts 3 and 4 when it is disposed between the rollers 1 and 2. The squeezing pressure is obtained by feeding pressurised fluid into the lower chambers of the cylinders 15 and 16 in order to raise the pistons 36, 37. In this manner the lower roller is thrust by means of its own end supports 32, 33 against the upper roller retained by the bracing members 17, 18 and 19, 20.

When it is desired to remove the belts 3 and 4 from the apparatus, the tension thereon is first eliminated by releasing the tension rollers 5, 6 from the respective spindles 9, 10 and hence causing the said rollers to slide on the guides 7, 8 until they move past the edge 11*a* of the side plate 11, as shown in FIGS. 4 and 5, carrying one end of the rollers out of the guides and the rollers themselves to rest on the brackets 47, 48.

At this point, the ends of the rollers 1 and 2, corresponding to the supports 26 and 33, are raised by feeding pressurised fluid to cylinders 41 and 42 through the openings indicated by the arrows B and C (see FIG. 3).

By feeding fluid under pressure, in the direction of the arrow B, to the cylinder 41, the lower roller 2 is pivoted on edgewise support 32*b* and its end support 32 is urged downwardly by cylinder 41 connected to the support 32, the piston 43 being fixedly connected to the bracket 45. This raises opposite end support 32.

Within the same period, before or after, fluid is fed under pressure in the direction of the arrow C to the cylinder 42 which, being connected to support 32, moves piston 44 downwardly and hence, by way of the collar 46 and the shaft 1*a*, raises the free end of the roller 1 forming a pivot on the oscillating bearing of known type disposed within the support 25.

As soon as the end of the rollers is raised even slightly, it is possible to extract the spacer 39 between support 33 and the piston 37 and remove the pins 31 from the lugs 24 of the support 26.

By also removing the pin or the like 27 from the extension 20*a*, both the bracing members 19, 20 may be rotated as shown in FIG. 4.

In this manner, both the ends of the rollers 1 and 2, as also those of the tension rollers 5 and 6 are released from any linkage, as shown in FIG. 4, and the belts 3 and 4 may be quickly removed from and re-inserted onto said rollers in a short time.

The resumption of the operating conditions of the apparatus is equally rapid, by connecting the bracing members 19, 20 to the respective lugs, by way of the pins 31 and 27, reinserting the spacer 39 on the piston 37 and lowering the ends of the rollers 1, 2 by discharging fluid from the cylinders 41, 42. The tension rollers 5, 6 are then again placed under traction by re-insertion in their ends the screws 9, 10.

It is understood that numerous variants of a constructional type may be applied, in particular with regard to the means for pivoting the pressure rollers, since they may be of any type in addition to that described, as well as fixing of the tie rods without departing from the scope of the present invention.

What I claim is:

1. An endless belt press comprising (a) an upper endless belt and a lower endless belt cooperating with the upper belt, (b) a belt support roller and a belt tensioning roller for each of the belts, the endless belts being trained over the support and tensioning rollers therefor, (1) the support rollers, with the belts trained thereover, defining a press nip therebetween, (c) a pair of end supports for each of the support rollers, (d) a pair of thrust means, a respective one of the end supports of the support roller for the lower belt resting on a respective one of the thrust means and the thrust means being arranged to exert a thrust against the support roller for the lower belt for displacing the same towards the support roller for the upper belt, (e) two pairs of like bracing members, (1) the bracing members of each pair having one end pivoted to a respective one of the thrust means for pivoting in a plane substantially perpendicular to the axes of the support rollers, (2) each pair of bracing members defining a guide for the displacement of the end supports of the support roller for the lower belt and (3) the end supports of the support roller for the upper belt being detachably fixed to the other ends of each pair of bracing members, (f) a pivot mounting for one of the end supports of each support roller, the pivot mounting being arranged to permit pivoting of the support rollers in a plane defined by the axes of the support rollers, and (g) traction means connected to the one end support of each support roller for pivoting the support rollers on the pivot mounting whereby the other end supports thereof are raised and the raised end support of the support roller for the lower belt no longer rests on the thrust means.

2. The endless belt press of claim 1, further comprising a pair of side plates, each side plate and the end supports on one side of the support rollers extending substantially in the same plane generally parallel to the plane wherein the bracing members are pivotal, one of the side plates being wider than the other side plate whereby a free space is defined between an edge of the other side plate and an adjacent one of the bracing members for the other end supports, guides mounted on the side plates for slidingly guiding the tensioning rollers whereby the tensioning rollers may be displaced in relation to the support rollers, and brackets mounted resiliently on the one side plate and arranged to receive the tensioning rollers from the guides when they are no longer slidingly guided in the guides and one of the ends of the tensioning rollers is in alignment with the free space.

3. The endless belt press of claim 2, further comprising a bracing arm extending from the adjacent bracing member towards the edge of the other side plate, the bracing arm being detachably connected to the other side plate.

4. The endless belt press of claim 1, wherein the traction means is arranged to generate a force perpendicular to the axes of the support rollers, the traction means being a double-acting pressure cylinder means interconnecting the one end supports of the support rollers.

5. The endless belt press of claim 1, further comprising a removable spacer member arranged between one of the thrust means and the other end support of the support roller for the lower belt, and the one end support thereof resting on the pivot mounting therefor.

* * * * *